US008408124B2

(12) United States Patent
Aoki

(10) Patent No.: US 8,408,124 B2
(45) Date of Patent: Apr. 2, 2013

(54) TRANSPORT CYLINDER GRIPPER PAD HEIGHT ADJUSTMENT DEVICE

(75) Inventor: Takanobu Aoki, Ibaraki (JP)

(73) Assignee: Komori Corporation, Tokyo (JP)

( * ) Notice: Subject to any disclaimer, the term of this patent is extended or adjusted under 35 U.S.C. 154(b) by 257 days.

(21) Appl. No.: 12/813,453

(22) Filed: Jun. 10, 2010

(65) Prior Publication Data

US 2010/0313777 A1 Dec. 16, 2010

(30) Foreign Application Priority Data

Jun. 15, 2009 (JP) ..... 2009-142053

(51) Int. Cl.
*B41F 21/10* (2006.01)

(52) U.S. Cl. ..... 101/232; 101/409; 271/82

(58) Field of Classification Search ..... 101/409, 101/232; 271/82, 277
See application file for complete search history.

(56) References Cited

U.S. PATENT DOCUMENTS 4,667,952 A 5/1987 Jeschke et al.
5,465,663 A * 11/1995 Bayer et al. ..... 101/409
5,611,277 A * 3/1997 Bayer et al. ..... 101/232
2008/0148976 A1* 6/2008 Sasaki ..... 101/409

FOREIGN PATENT DOCUMENTS

EP 0 703 073 3/1996
JP H11-048449 A 2/1999
JP 2003-25547 1/2003

* cited by examiner

*Primary Examiner* — Leslie J Evanisko
(74) *Attorney, Agent, or Firm* — Blakely, Sokoloff, Taylor & Zafman

(57) ABSTRACT

A device is presented for adjustment of height in a transport cylinder gripper pad. The device includes a first notch, a gripper pad which is equipped in the first notch, a gripper pad bar, a first adjusting bar, a biasing member which biases the bottom surface of the gripper pad bar against the upper surface of the first adjusting bar, a drive shaft, and a driving unit which moves the drive shaft in the cylinder axial direction. A first connecting portion is interposed between the drive shaft and the first adjusting bar, and moves the first adjusting bar in the cylinder axial direction as the drive shaft moves.

6 Claims, 9 Drawing Sheets

TRANSPORT CYLINDER GRIPPER PAD HEIGHT ADJUSTMENT DEVICE

BACKGROUND OF THE INVENTION

The present invention relates to a transport cylinder gripper pad height adjustment device which adjusts the height of a gripper pad of a transport cylinder in, e.g., a sheet-fed offset rotary printing press in accordance with the thickness of a sheet.

In a sheet-fed offset rotary printing press, a sheet fed by a feeder is gripped by a gripper device equipped in a notch formed in the outer peripheral portion of a transport cylinder including, e.g., an impression cylinder, transfer cylinder, and delivery cylinder, is printed during transportation, and is delivered by a delivery device. The gripper device includes a plurality of pairs of a gripper and a gripper pad which are opposed to each other in the notch. The spaces between all grippers and all gripper pads are opened/closed at once at the sheet gripping positions, and the sheet is transported while being gripped between the grippers and the gripper pads. In a gripper device of this type, the interval between grippers and gripper pads, i.e., the height of the gripper pads needs to be adjusted in accordance with the thickness of a sheet.

A conventional transport cylinder gripper pad height adjustment device includes a notch, gripper pads, gripper pad bar, adjusting bar, biasing means, and operating shaft (see patent reference 1: Japanese Patent Laid-Open No. 11-48449). The notch extends in the cylinder axial direction in the outer peripheral portion of a transport cylinder. The gripper pads are equipped in the notch, and grip a sheet together with grippers. The gripper pad bar has the gripper pads fixed on it, and has a bottom portion inclined with respect to the cylinder axial direction so that it is restricted in movement in the cylinder axial direction and supported to be movable in the cylinder radial direction. The adjusting bar has an inclined surface in contact with the inclined surface of the gripper pad bar, and is supported to be movable in the cylinder axial direction in the notch. The biasing means biases the inclined surface of the gripper pad bar against that of the adjusting bar in the direction to bring them into press contact with each other. The operating shaft moves the adjusting bar in the cylinder axial direction.

The above-mentioned conventional gripper pad height adjustment device has a structure in which the operating shaft extends through a through hole which is formed in the end shaft of the transport cylinder to be directed in the radial direction of the cylinder, so the operating shaft rotates by interlocking with rotation of the transport cylinder. Therefore, the height of the gripper pads cannot be adjusted while the transport cylinder rotates during, e.g., roller cleaning or plate replacement even during non-printing. Thus, it takes a long time for a sheet-fed offset rotary press to prepare for printing.

SUMMARY OF THE INVENTION

It is an object of the present invention to provide a transport cylinder gripper pad height adjustment device which shortens the time taken for a sheet-fed offset rotary press to prepare for printing.

In order to achieve the above object, according to the present invention, there is provided a transport cylinder gripper pad height adjustment device comprising a first notch formed in an outer peripheral portion of a transport cylinder in a cylinder axial direction, a gripper pad which is equipped in the first notch and grips a sheet in cooperation with a gripper, a gripper pad bar which includes the gripper pad fixed thereon, is restricted in movement in the cylinder axial direction and supported to be movable in a cylinder radial direction, the gripper pad bar having a bottom surface inclined with respect to the cylinder axial direction, a first adjusting bar which has an inclined upper surface in contact with the bottom surface of the gripper pad bar, and which is supported to be movable in the cylinder axial direction in the first notch, a biasing member which biases the bottom surface of the gripper pad bar against the upper surface of the first adjusting bar in a direction to bring the bottom surface into press contact with the upper surface, a drive shaft which is supported to be movable in the cylinder axial direction at the center of rotation of the transport cylinder, a driving unit which moves the drive shaft in the cylinder axial direction, and a first connecting portion which is interposed between the drive shaft and the first adjusting bar, and moves the first adjusting bar in the cylinder axial direction as the drive shaft moves.

DESCRIPTION OF THE PREFERRED EMBODIMENT

One embodiment of the present invention will be described below with reference to FIGS. 1 to 7.

Figure 1:
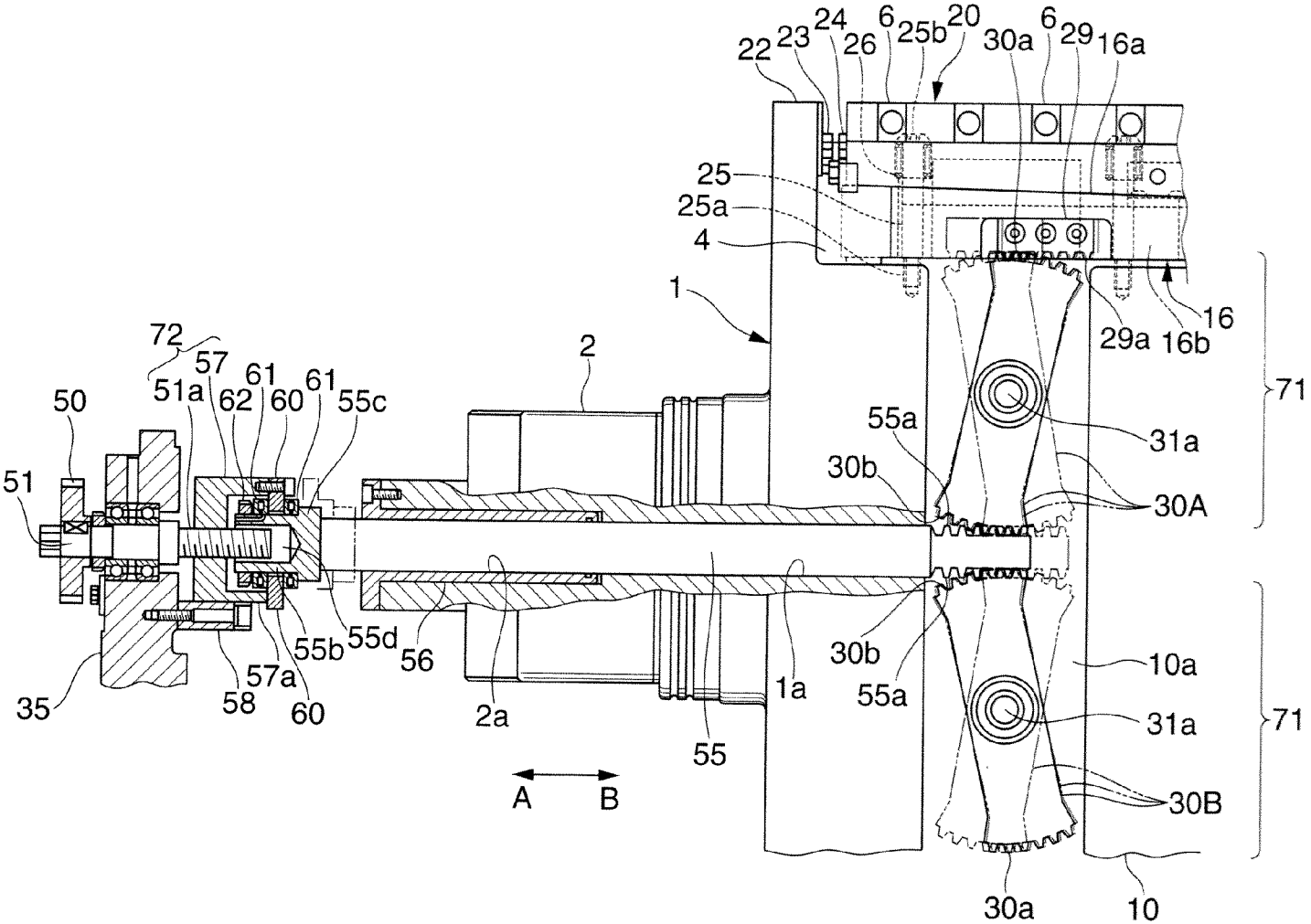
FIG. 1 is a partial side view showing the main part of a sheet transport cylinder gripper pad height adjustment device according to one embodiment of the present invention.

As shown in FIG. 1, a pair of end shafts 2 of a transfer cylinder 1 in a sheet-fed offset rotary printing press are rotatably supported by a pair of frames (not shown). Notches 4 (one notch is not shown) are formed in the outer peripheral portion of the transfer cylinder 1 over the entire region in the cylinder axial direction so as to be 180° out of phase with each other in the cylinder rotation direction. The notch 4 accommodates a gripper device 7 including grippers 5 and gripper pads 6 which grip a sheet in cooperation with the grippers 5.

Figure 2A:
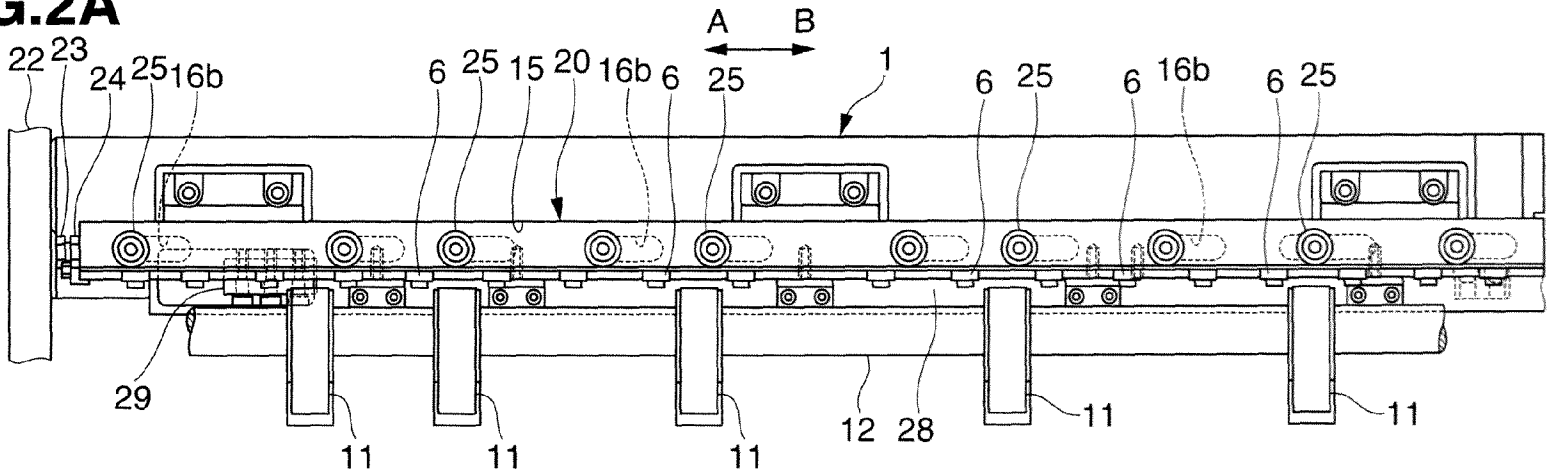
FIGS. 2A and 2B are a plan view and side view, respectively, of the gripper pad height adjustment device shown in FIG. 1.
Figure 5:
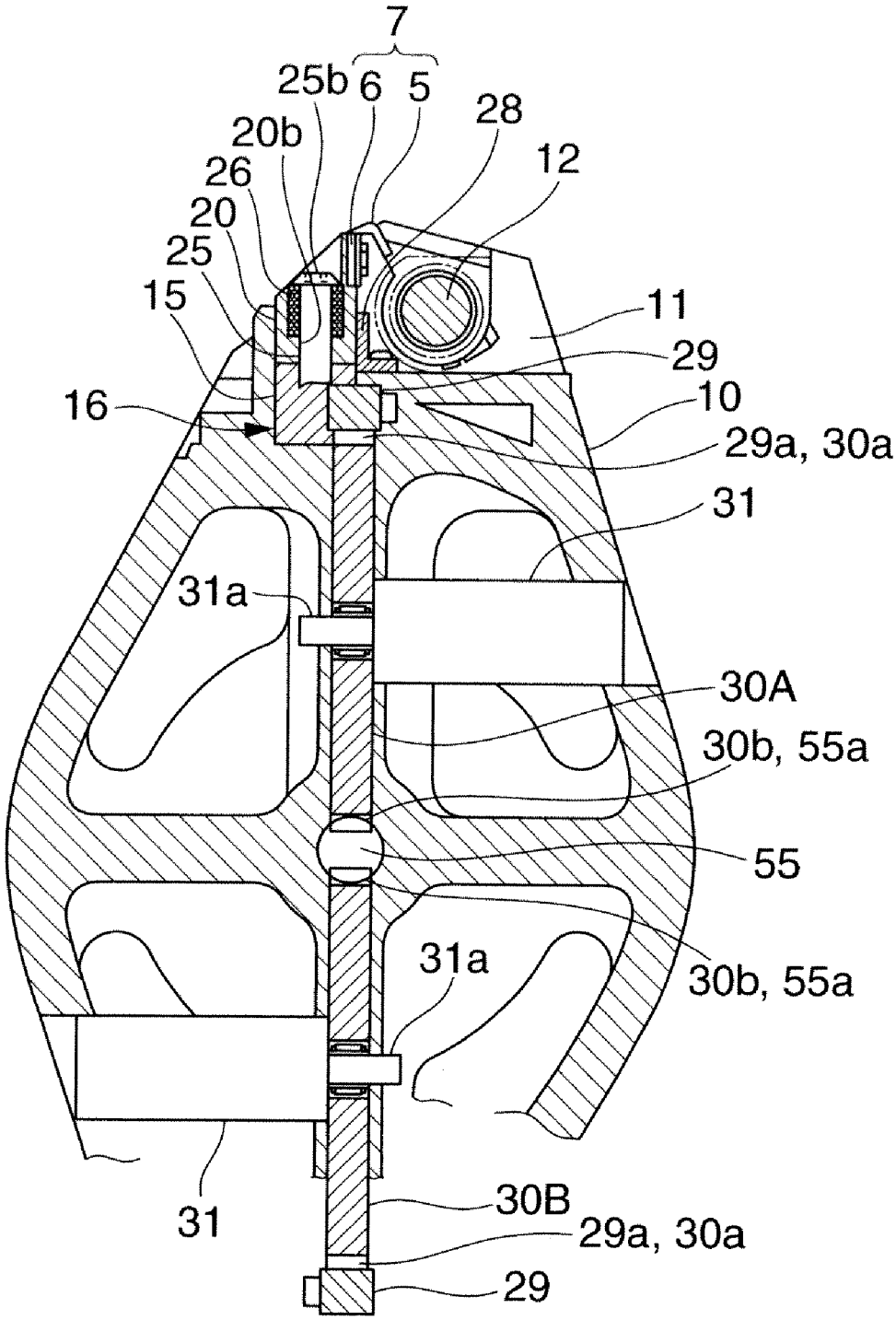
FIG. 5 is a sectional view taken along a line VI-VI in FIG. 2B.

A plurality of holders 11 are fixed on the upper surface of a base 10, projecting from the bottom portion of the notch 4, to be juxtaposed in the cylinder axial direction, as shown in FIG. 2A. The holder 11 pivotably supports a gripper shaft 12 which axially mounts the grippers 5, as shown in FIG. 5. When the transfer cylinder 1 is pivoted and positioned at a predetermined pivoting position (when the gripper device 7 is positioned at the paper gripping position), a cam mechanism (not shown) pivots the gripper shaft 12. In this way, the grippers 5 open/close with respect to the gripper pads 6, and grip one end of paper.

Figure 2B:
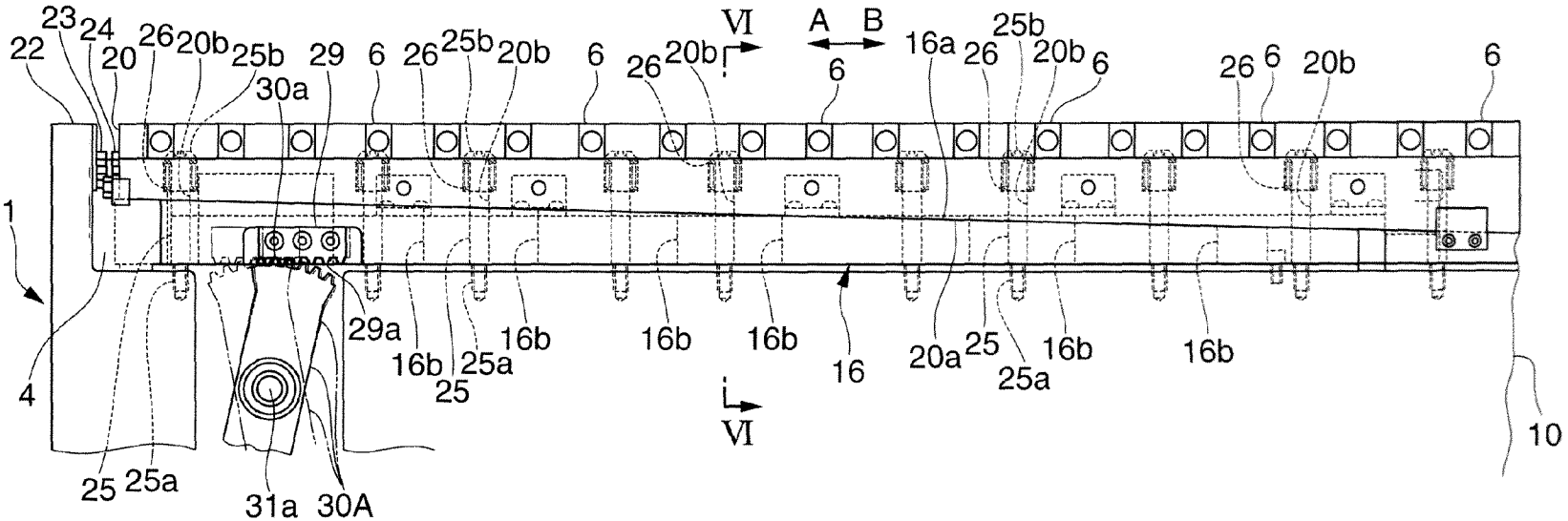

A guide groove 15 is formed in the upper portion of the base 10 over the entire region in the cylinder axial direction. A long adjusting bar 16 with a rectangular cross-section is provided in the guide groove 15 so as to extend in the cylinder axial direction. The adjusting bar 16 has an upper surface 16*a* formed to be inclined in the cylinder axial direction (directions indicated by arrows A and B), as shown in FIG. 2B. The adjusting bar 16 in which a plurality of elongated holes 16*b* are juxtaposed in the cylinder axial direction is supported to be slidable in the cylinder axial direction in the guide groove 15.

A plurality of gripper pads 6 are equidistantly fixed on a gripper pad bar 20 in the cylinder axial direction. The gripper pad bar 20 has a bottom surface 20*a* formed to be inclined at the same angle of inclination as the upper surface 16*a* of the adjusting bar 16. The gripper pad bar 20 is provided in the guide groove 15 as it is attached on the adjusting bar 16 so that the bottom surface 20*a* comes into contact with the upper surface 16*a* of the adjusting bar 16. A plurality of through holes 20*b* corresponding to the elongated holes 16*b* in the adjusting bar 16 are formed in the gripper pad bar 20 in a stepped pattern. The overall length of the gripper pad bar 20 in the cylinder axial direction is slightly shorter than the length of the notch 4 in the cylinder axial direction, i.e., the interval between the transfer cylinder 1 and a pair of bearers 22 (one bearer 22 is not shown).

The gripper pad bar 20 has two ends into which a pair of stoppers 23 (one stopper 23 is not shown) are screwed. Movement of the gripper pad bar 20 in the cylinder axial direction in the notch 4 is restricted by abutting each stopper 23 against the inner wall surface of the bearer 22. One stopper 23 is formed from a screw which is retractable from the end of the gripper pad bar 20 so as to be adjusted in response to a change in interval between the end of the gripper pad bar 20 and the inner wall surface of the bearer 22. The amount of insertion/retraction of the stopper 23 is set by locking a nut 24 which threadably engages with the stopper 23 into the end of the gripper pad bar 20.

As shown in FIG. 2B, a bolt 25 has, at its distal end, a threaded portion 25*a* which threadably engages with the base 10 while the bolt 25 is loosely inserted in the through hole 20*b* in the gripper pad bar 20 and in the elongated hole 16*b* in the adjusting bar 16. A compression spring 26 is elastically attached to a head 25*b* of the bolt 25 and the stepped portion of the through holes 20*b*. The bottom surface 20*a* of the gripper pad bar 20 is brought into press contact with the upper surface 16*a* of the adjusting bar 16 by the elastic force of the compression spring 26.

A guide bar 28 with nearly the same overall length as the gripper pad bar 20 is formed to have an L-shaped cross-section, as shown in FIG. 5. The guide bar 28 is fixed on the bottom surface of the notch 4 so as to guide fine movement of the gripper pad bar 20 in the radial direction of the transfer cylinder 1 (height adjustment of the gripper pads 6) in cooperation with the guide groove 15. A rack plate 29 including a rack 29*a* on its lower surface is fixed at one end of the adjusting bar 16 by a bolt, as shown in FIG. 1. Such a rack plate is also fixed on an adjusting bar provided in the other one of the pair of notches 4.

An accommodation space 10*a* is formed between one end of the base 10 and the central portion of the inner wall surface of one of the bearers 22, and extends through the central portion of the transfer cylinder 1 and the bottom portion of the notch 4. The accommodation space 10*a* accommodates a pair of rectangular pivoting plates 30A and 30B which function as a connecting member. The pivoting plates 30A and 30B have central portions which are rotatably supported through bearings by shaft portions 31*a* of support members 31 fixed on the base 10, as shown in FIG. 5. Each of the pivoting plates 30A and 30B includes a pair of pinions 30*a* and 30*b* formed in its edge portions which are 180° out of phase with each other in the pivoting direction. The pinions 30*a* of the pivoting plates 30A and 30B mesh with the racks 29*a* of the rack plates 29 fixed on the adjusting bars 16 equied in the notches 4, as shown in FIG. 1. The pinions 30*b* of the pivoting plates 30A and 30B mesh with racks 55*a* of a drive shaft 55 (to be described later). The pivoting plates 30A and 30B, pinions 30*a* and 30*b*, and racks 29*a* form a connecting portion 71.

Figure 3:
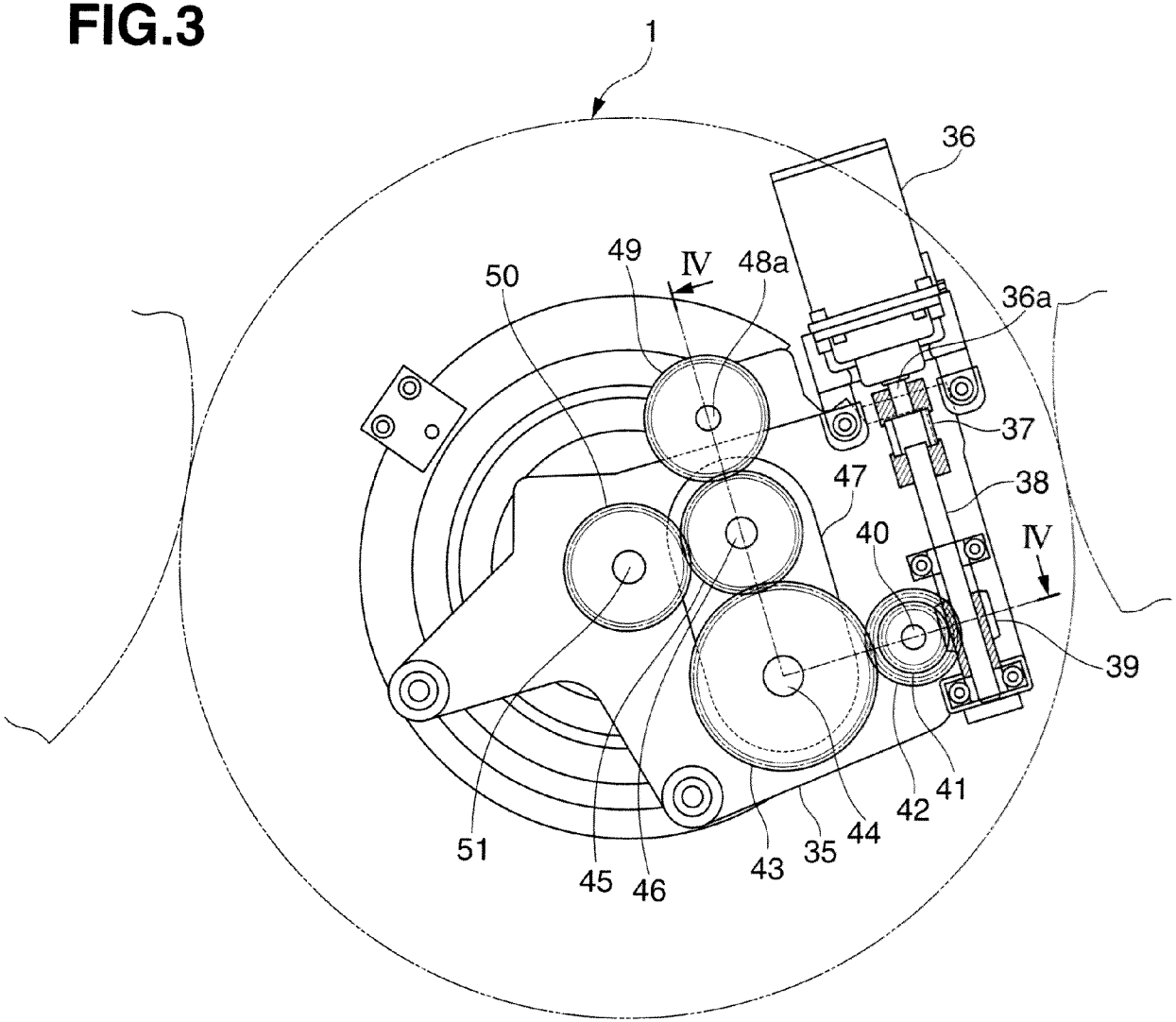
FIG. 3 is a front view of the main part of the gripper pad height adjustment device shown in FIG. 1.

As shown in FIG. 1, a support plate 35 is parallelly attached to a frame (not shown) through a stud (not shown). An adjusting motor 36 which is rotationally driven in the forward/reverse direction is fixed on the support plate 35, as shown in FIG. 3. The adjusting motor 36 has an output shaft 36*a* connected to one end of a transmission shaft 38 through a coupling 37. The transmission shaft 38 is restricted in movement in the axial direction and rotatably supported by the support plate 35. A worm 39 is axially mounted at the other end of the transmission shaft 38.

Figure 4:
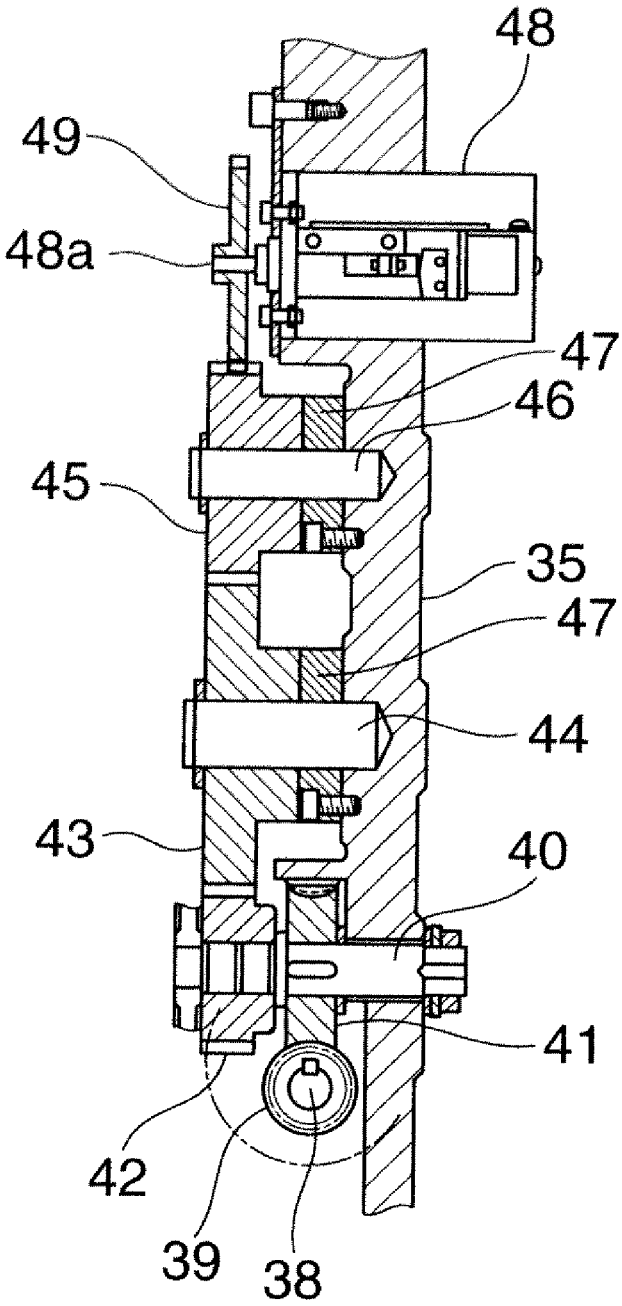
FIG. 4 is a sectional view taken along a line IV-IV in FIG. 3.

A worm wheel 41 and gear 42 are coaxially mounted on a shaft 40 which is rotatably supported by the support plate 35, as shown in FIG. 4. The worm wheel 41 meshes with the worm 39. A gear 43 is rotatably supported by a pin 44 implanted in the support plate 35, and meshes with the gear 42. A gear 45 is rotatably supported by a pin 46 implanted in the support plate 35, and meshes with the gear 43. A spacer 47 is interposed between the gears 43 and 45 and the support plate 35.

An encoder 48 which detects the height of the gripper pads 6 is attached to the support plate 35. A gear 49 which meshes with the gear 45 is axially mounted on a detection shaft 48*a* of the encoder 48. A drive gear 50 (FIG. 3) which meshes with the gear 45 is axially mounted at one end of a rotary shaft 51 which is rotatably supported by the support plate 35, as shown in FIG. 1. A threaded rod 51*a* is integrally formed at the other end of the rotary shaft 51 to project to the inside of the support plate 35. In this arrangement, rotation of the output shaft 36*a* is transmitted to the drive gear 50 and gear 49 via the transmission shaft 38, worm 39, worm wheel 41, and gears 42, 43, and 45 by driving the adjusting motor 36 in the forward/reverse direction.

The drive shaft 55 is supported to be rotatable and movable in the axial direction (directions indicated by arrows A and B) through a thrust bearing 56 in a support hole 2*a* formed at the central portion of the end shaft 2 of the transfer cylinder 1, as shown in FIG. 1. The drive shaft 55 extends through a central hole 1*a* formed at the center of rotation of the end of the transfer cylinder 1, and has its one end facing the accommodation space 10*a*. The pair of racks 55*a* which mesh with the pinions 30*b* of the pair of pivoting plates 30A and 30B are partially formed on the outer peripheral surface of one end of the drive shaft 55, projecting into the accommodation space 10*a*, so as to be 180° out of phase with each other in the axial rotation direction. The drive shaft 55 has its other end 55*b* which projects to the outside of the support hole 2*a* and at which a flange 55*c* and a recess 55*d* facing the threaded rod 51*a* are formed.

A bottomed cylindrical slider 57 has a bottom central portion which threadably engages with the threaded rod 51*a*, and an outer peripheral surface which partially serves as a flat engaging surface 57*a*. A rectangular parallelepiped locking member 58 is fixed on the support plate 35. Rotation of the slider 57 is restricted by making the locking member 58 engage with the engaging surface 57*a* of the slider 57. A connecting ring 60 is loosely fitted into the peripheral surface of the other end 55*b* of the drive shaft 55, and is fixed on the open end of the slider 57. The adjusting motor 36, threaded rod 51*a*, and slider 57 form a driving unit 72.

A pair of bearings 61 which rotatably support the drive shaft 55 are fixed on two surfaces of the connecting ring 60 so as to pinch the connecting ring 60 between them while being clamped by the flange 55*c* and a nut 62 which threadably engages with the distal end of the other end 55*b* of the drive shaft 55. That is, the pair of bearings 61 are fixed to the slider through the connecting ring 55 and connect the slider 57 and the drive shaft 55 to each other. In this arrangement, as the slider 57 moves in directions indicated by arrows A and B upon rotation of the threaded rod 51*a*, the drive shaft 55 moves in the cylinder axial direction (directions indicated by arrows A and B) through the connecting ring 60, bearings 61, nut 62, and flange 55*c*, together with the slider 57. At this time, the bearings 61 rotatably support the drive shaft 55.

Hence, as the threaded rod 51*a* rotates clockwise/counterclockwise upon driving of the adjusting motor 36, the drive shaft 55 moves in the cylinder axial direction (directions indicated by arrows A and B). At this time, when the transfer cylinder 1 rotates, the drive shaft 55 which is rotatably supported by the bearings 61 rotates, together with the transfer cylinder 1, through the pinions 30*b* of the pivoting plates 30A and 30B and the racks 55*a*.

Figure 6:
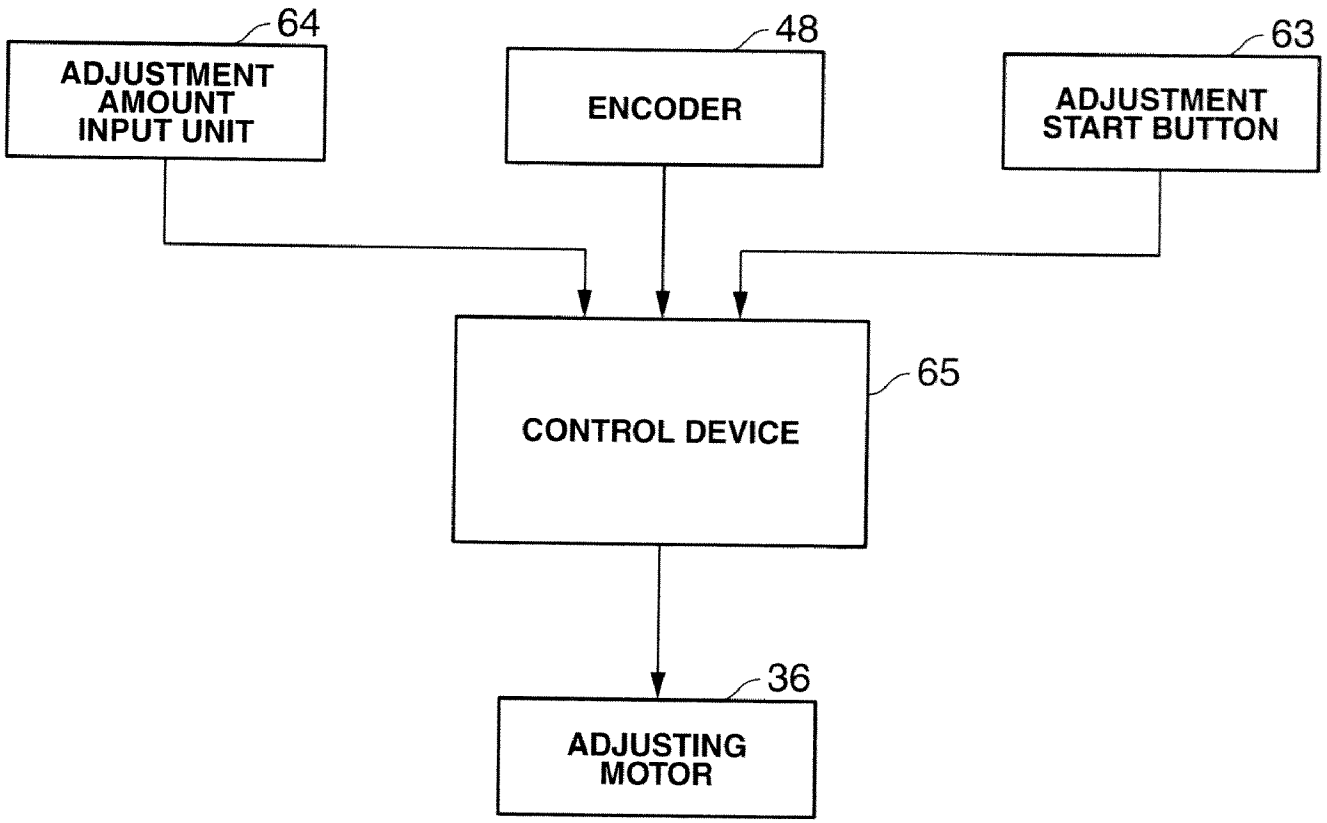
FIG. 6 is a block diagram showing the electrical arrangement of the gripper pad height adjustment device shown in FIG. 1.

An electrical arrangement according to this embodiment will be described with reference to FIG. 6. An adjustment start button 63 instructs the start of height adjustment of the gripper pads 6. An adjustment amount input unit 64 includes a keyboard device and receives the height adjustment amount of the gripper pads 6 based on, e.g., the thickness of a sheet. A control device 65 controls driving of the adjusting motor 36 by comparing the height of the gripper pads 6 detected by the encoder 48 with that input from the adjustment amount input unit 64. The control device 65 receives the button operation information of the adjustment start button 63.

Figure 7:
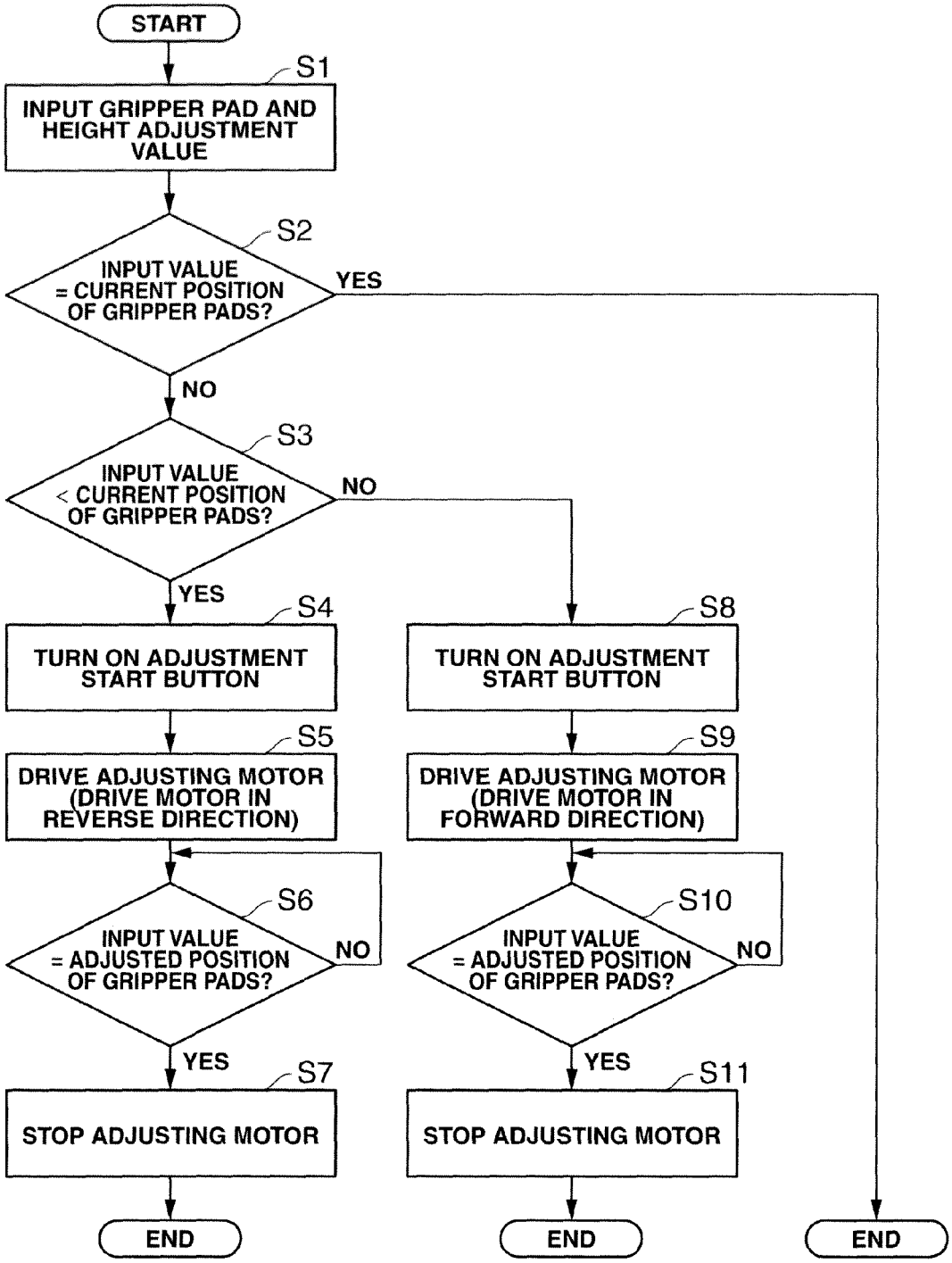
FIG. 7 is a flowchart for explaining the adjustment operation of the gripper pad height adjustment device shown in FIG. 1.

An operation for adjusting the height of the gripper pads 6 by the control device 65 will be described next with reference to FIG. 7. First, the height adjustment amount of the gripper pads 6 is input to the adjustment amount input unit 64 by the operator's manipulation (step S1). Next, it is determined whether the current position of the gripper pads 6 detected by the encoder 48 is equal to the gripper pad height adjustment input value (to be referred to as the adjustment input value hereinafter) (step S2). If the current position is equal to the adjustment input value, the adjustment operation ends. On the other hand, if the current position is not equal to the adjustment input value, the control device 65 determines whether the current position of the gripper pads 6 is larger (higher) than the adjustment input value (step S3).

If the current position is larger than the adjustment input value, the adjusting motor 36 is driven in the reverse direction by turning on the adjustment start button 63 (steps S4 and S5). The rotational motion of the output shaft 36*a* is transmitted to the drive gear 50 via the transmission shaft 38, worm 39, worm wheel 41, and gears 42, 43, and 45 upon the driving of the adjusting motor 36 in the reverse direction. The drive gear 50 rotates counterclockwise in FIG. 3, and the counterclockwise rotation of the drive gear 50 is transmitted to the threaded rod 51*a* via the rotary shaft 51. In this way, the slider 57 which threadably engages with the rotary shaft 51 moves in a direction indicated by an arrow B in FIG. 1 (a direction closer to the transfer cylinder 1), and the drive shaft 55 moves in the same direction, together with the slider 57.

The pivoting plate 30A pivots counterclockwise about the shaft portion 31*a* as the center of rotation through the rack 55*a* and pinion 30*b* upon the movement of the drive shaft 55 in a direction indicated by an arrow B. As the rack plate 29 including the rack 29*a* which meshes with the pinion 30*a* of the pivoting plate 30A moves in a direction indicated by an arrow A (a direction away from the transfer cylinder 1) upon the pivoting of the pivoting plate 30A, the adjusting bar 16 integrated with the rack plate 29 also moves in a direction indicated by an arrow A in FIG. 2B. In this way, the gripper pad bar 20 having the inclined surface 20*a* in contact with the inclined surface 16*a* of the adjusting bar 16 descends, and the position of the gripper pads 6, in turn, drops.

During this operation, the control device 65 determines whether the adjusted height of the gripper pads 6 is equal to the adjustment input value (step S6). If the adjusted height is not equal to the adjustment input value, the control device 65 repeats the process in step S6 until they become equal to each other. On the other hand, if the adjusted height is equal to the adjustment input value, the adjusting motor 36 stops its driving (step S7), and the adjustment operation ends.

If it is determined in step S3 that the current position of the gripper pads 6 is smaller (lower) than the adjustment input value, the adjusting motor 36 is rotationally driven in the forward direction by turning on the adjustment start button 63 (step S9). The rotational motion of the output shaft 36*a* is transmitted to the drive gear 50 via the transmission shaft 38, worm 39, worm wheel 41, and gears 42, 43, and 45 upon the driving of the adjusting motor 36 in the forward direction. The drive gear 50 rotates clockwise in FIG. 3, and the clockwise rotation of the drive gear 50 is transmitted to the threaded rod 51*a* via the rotary shaft 51 in FIG. 1. In this way, the slider 57 which threadably engages with the rotary shaft 51 moves in a direction indicated by an arrow A, and the drive shaft 55 moves in the same direction, together with the slider 57.

The pivoting plate 30A pivots clockwise about the shaft portion 31*a* as the center of rotation through the rack 55*a* and pinion 30*b* upon the movement of the drive shaft 55 in a direction indicated by an arrow A. As the rack plate 29 including the rack 29*a* which meshes with the pinion 30*a* of the pivoting plate 30A moves in a direction indicated by an arrow B upon the pivoting of the pivoting plate 30A, the adjusting bar 16 integrated with the rack plate 29 also moves in a direction indicated by an arrow B in FIG. 2B. In this way, the gripper pad bar 20 having the inclined surface 20*a* in contact with the inclined surface 16*a* of the adjusting bar 16 ascends, and the position of the gripper pads 6, in turn, rises.

During this operation, the control device 65 determines whether the adjusted height of the gripper pads 6 is equal to the adjustment input value (step S10). If the adjusted height is not equal to the adjustment input value, the control device 65 repeats the process in step S10 until they become equal to each other. On the other hand, if the adjusted position of the gripper pads 6 is equal to the adjustment input value, the adjusting motor 36 stops its driving (step S11), and the adjustment operation ends.

According to this embodiment, the drive shaft 55 which serves to adjust the height of the gripper pads 6 and moves in the axial direction is set at the center of rotation of the transfer cylinder 1. Hence, the position of the drive shaft 55 in the radial direction stays constant even while the transfer cylinder 1 rotates. This makes it possible to adjust the height of the gripper pads 6 even while the transfer cylinder 1 rotates during, e.g., roller cleaning or plate replacement, thus shortening the overall time taken for a sheet-fed offset rotary press to prepare for printing.

Figure 8:
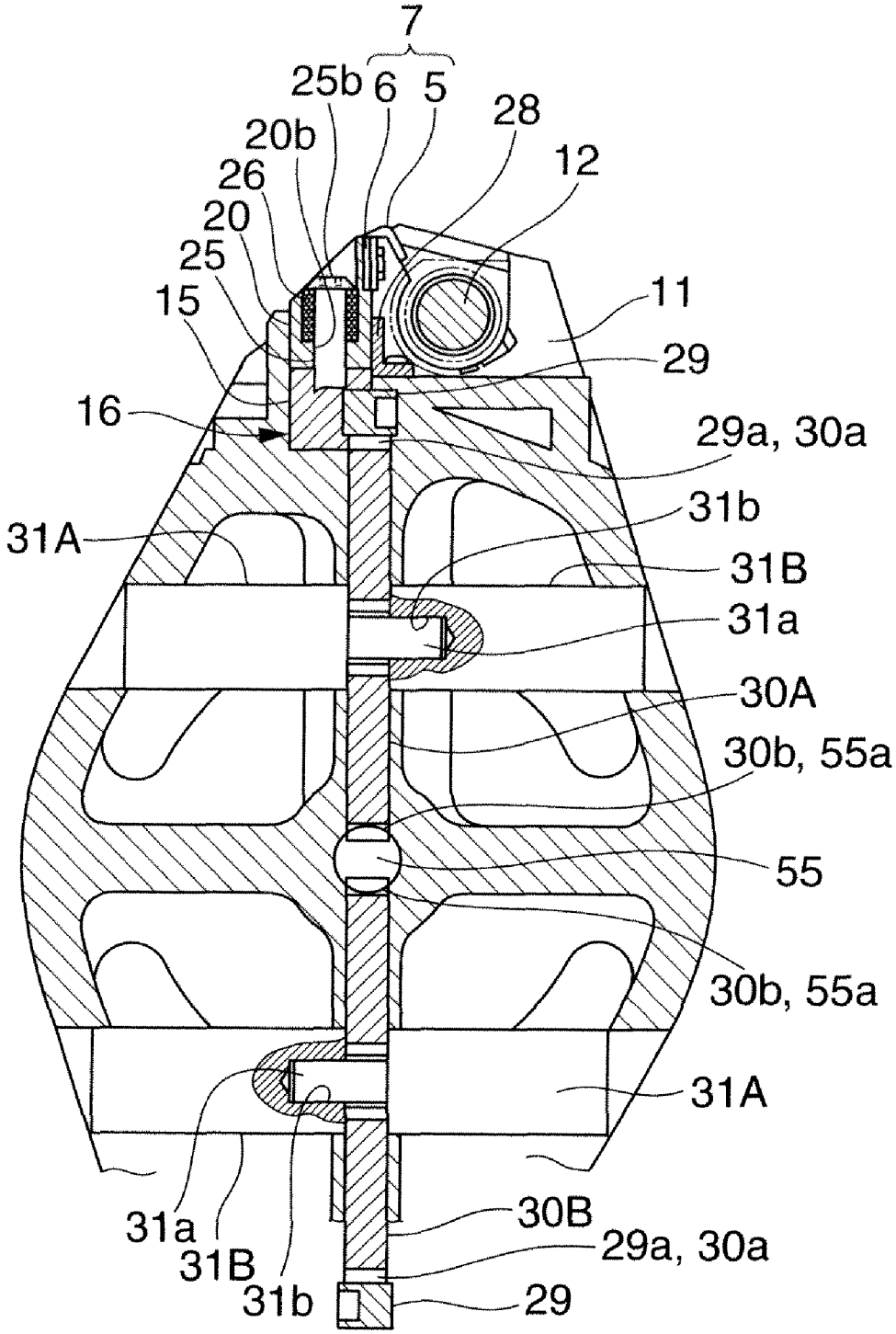
FIG. 8 is a sectional view, taken along a line VI-VI in FIG. 2B, which shows a modification of the support structure of pivoting plates.

A modification of the support structure of pivoting plates will be described next with reference to FIG. 8. The structure according to this modification is different from that shown in FIG. 5 in that in the former a pair of support members 31A and 31B support pivoting plates 30A and 30B from both sides. A shaft portion 31*a* of the support member 31A is supported by a recess 31*b* in the support member 31B. This reduces positional shifts of the centers of rotation of the pivoting plates 30A and 30B. Hence, pinions 30*a* of the pivoting plates 30A and 30B smoothly mesh with racks 29*a* of rack plates 29, and pinions 30*b* of the pivoting plates 30A and 30B smoothly mesh with racks 55*a* of a drive shaft 55.

Figure 9:
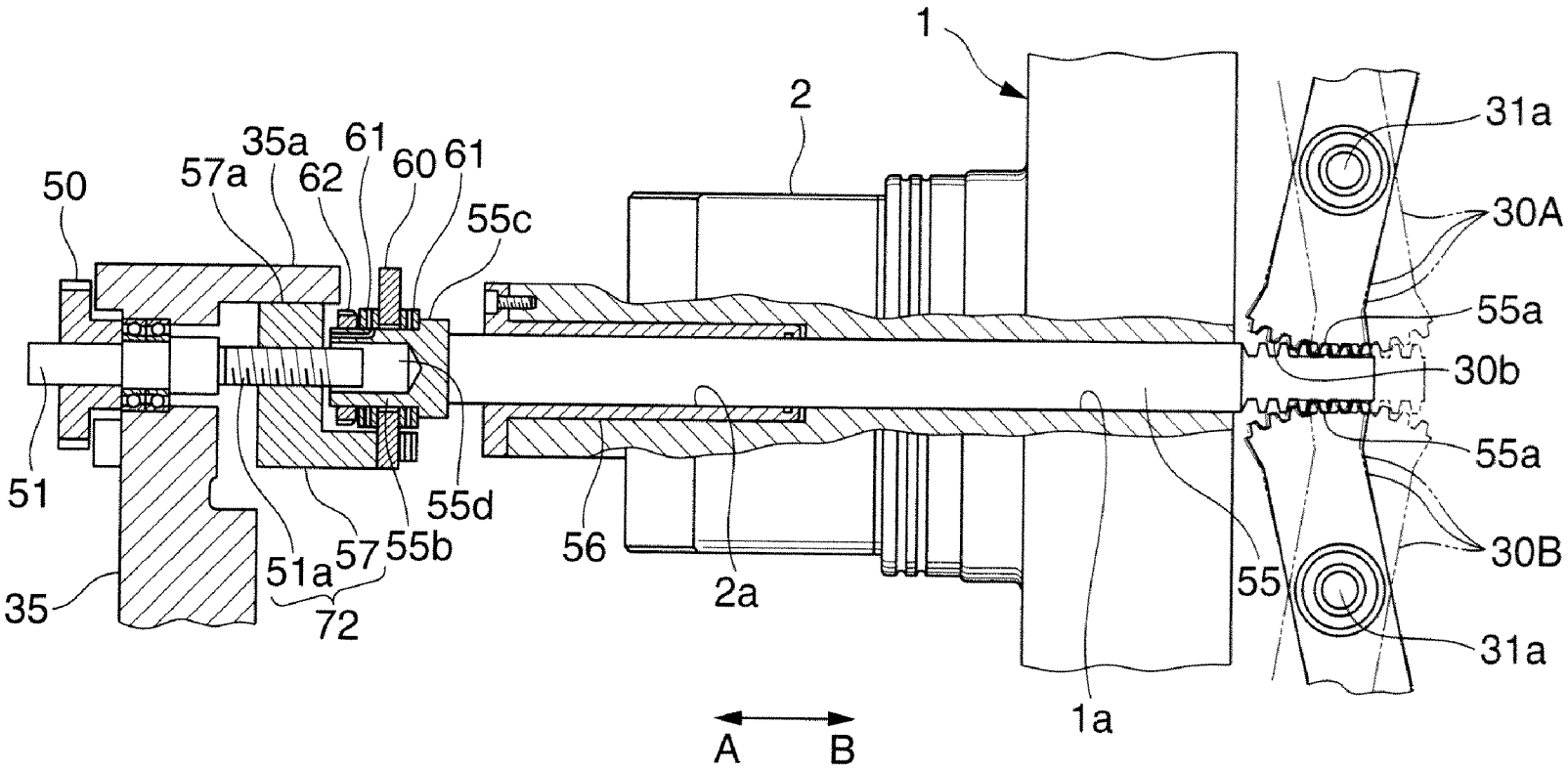
FIG. 9 is a partial side view showing the main part of a modification of a structure for restricting rotation of a slider.

A modification of a structure for restricting rotation of a slider will be described next with reference to FIG. 9. The structure shown in FIG. 1 restricts rotation of the slider 57 by making the locking member 58 fixed on the support plate 35 engage with the engaging surface 57*a* of the slider 57. In this modification, an engaging portion 35*a* integrally projects from a support plate 35 toward a transfer cylinder 1 so that an engaging surface 57*a* of a slider 57 engages with the engaging portion 35*a*.

Although the pair of pinions 30*a* and 30*b* are formed in two edge portions of each of the rectangular pivoting plates 30A and 30B in the above-described embodiment, pinions may be formed over the entire peripheral edge of each circular pivoting plate. A pair of pinions may also be partially formed at positions which are 180° out of phase with each other on the edge of each circular pivoting plate.

Although the pair of racks 55*a* are partially formed at the end of the drive shaft 55 in the above-described embodiment, racks may be formed over the entire periphery of the end of the drive shaft 55. Also, although an example in which the present invention is applied to a transfer cylinder has been given, the present invention is also applicable to various types of cylinders in a sheet-fed offset rotary printing press, such as an impression cylinder and a delivery cylinder.

According to the present invention, a drive shaft for adjusting the height of gripper pads can be operated while a transport cylinder rotates because the drive shaft is formed at the center of rotation of the transport cylinder so that the position of the drive shaft stays constant even upon the rotation of the transport cylinder. This makes it possible to adjust the height of the gripper pads even while the transport cylinder rotates during, e.g., roller cleaning or plate replacement, thus shortening the overall time taken for a sheet-fed offset rotary press to prepare for printing.

What is claimed is:

1. A transport cylinder gripper pad height adjustment device comprising:

a first notch formed in an outer peripheral portion of a transport cylinder in a cylinder axial direction;

a gripper pad which is equipped in said first notch and grips a sheet in cooperation with a gripper;

a gripper pad bar which includes said gripper pad fixed thereon, is restricted in movement in the cylinder axial direction and supported to be movable in a cylinder radial direction, said gripper pad bar having a bottom surface inclined with respect to the cylinder axial direction;

a first adjusting bar which has an inclined upper surface in contact with said bottom surface of said gripper pad bar, and which is supported to be movable in the cylinder axial direction in said first notch;

a biasing member which biases said bottom surface of said gripper pad bar against said upper surface of said first adjusting bar in a direction to bring said bottom surface into press contact with said upper surface;

a drive shaft which is supported to be movable in the cylinder axial direction at the center of rotation of the transport cylinder;

a driving unit which moves said drive shaft in the cylinder axial direction;

a first connecting portion which is interposed between said drive shaft and said first adjusting bar, and moves said first adjusting bar in the cylinder axial direction as said drive shaft moves;

a second notch formed in the outer peripheral of the transport cylinder so as to be 180° out of phase with said first notch in a cylinder rotation direction;

a second adjusting bar which is supported to be movable in the cylinder axial direction in said second notch;

a second connecting portion which is interposed between said drive shaft and said second adjusting bar, and moves said second adjusting bar in the cylinder axial direction as said drive shaft moves;

bearings which are fixed to a slider and connect said slider, and said drive shall while supporting rotatably said drive shaft;

wherein said first connecting portion and said second connecting portion comprise first racks formed on said drive shaft, second racks formed on said first adjusting bar and said second adjusting bar, and pinions which mesh with said first racks and said second racks; and wherein said driving unit comprises a motor driven in a forward/reverse direction, a threaded rod which rotates by interlocking, with rotation of said motor, and the slider which moves in the cylinder axial direction, together with said drive shalt, as said threaded rod rotates.

2. A device according to claim 1, wherein said first connecting portion further comprises a pivoting plate which is supported to be pivotable in the cylinder axial direction in a space which extends through the center of rotation of the transport cylinder and a bottom portion of said first notch, and said pinions are partially formed in edge portions of said pivoting plate, which are 180° out of phase with each other in a rotation direction thereof.

3. A device according to claim 1, wherein said first connecting portion comprises a first connecting member connected between said drive shaft and said first adjusting bar in said first notch, and said second connecting portion comprises a second connecting member connected between said drive shaft and said second adjusting bar in said second notch.

4. A device according to claim 1, further comprising locking members which restrict rotation of said slider when said threaded rod rotates.

5. A device according to claim 1, wherein said motor is fixed to a frame through a support member.

6. A transport cylinder gripper pad height adjustment device comprising:

a first notch formed in an outer peripheral portion of a transport cylinder in a cylinder axial direction;

a gripper pad which is equipped in said first notch and grips a sheet in cooperation with a gripper;

a gripper pad bar which includes said gripper pad fixed thereon, is restricted in movement in the cylinder axial direction and supported to be movable in a cylinder radial direction, said gripper pad bar having a bottom surface inclined with respect to the cylinder axial direction;

a first adjusting bar which has an inclined upper surface in contact with said bottom surface of said gripper pad bar, and which is supported to be movable in the cylinder axial direction in said first notch;

a biasing member which biases said bottom surface of said gripper pad bar against said upper surface of said first adjusting bar in a direction to bring said bottom surface into press contact with said upper surface;

a drive shaft which is supported to be movable in the cylinder axial direction at the center of rotation of the transport cylinder;

a driving unit which moves said drive shaft in the cylinder axial direction; and a first connecting portion which is interposed between said drive shaft and said first adjusting bar, and moves said first adjusting bar in the cylinder axial direction as said drive shaft moves;

wherein said first connecting portion comprises a first rack formed on said drive shaft, a second rack formed on said first adjusting bar, and pinions which mesh with said first rack and said second rack;

wherein said first connecting portion further comprises a pivoting plate which is supported to be pivotable in the cylinder axial direction in a space which extends through the center of rotation of the transport cylinder and a bottom portion of said first notch, and said pinions are partially formed in edge portions of said pivoting plate, which are 180° out of phase with each other in a rotation direction thereof.

* * * * *

UNITED STATES PATENT AND TRADEMARK OFFICE

CERTIFICATE OF CORRECTION

PATENT NO. : 8,408,124 B2
APPLICATION NO. : 12/813453
DATED : April 2, 2013
INVENTOR(S) : Takanobu Aoki It is certified that error appears in the above-identified patent and that said Letters Patent is hereby corrected as shown below:

In the Claims, Column 8, Claim 1, line 20, please delete “shall” and insert --shaft--.

Signed and Sealed this
Fifteenth Day of October, 2013

Teresa Stanek Rea
*Deputy Director of the United States Patent and Trademark Office*